US005910070A

United States Patent [19]

Henry et al.

[11] Patent Number: 5,910,070

[45] Date of Patent: Jun. 8, 1999

[54] WEIGHTED HAND-CONTROLLER FOR REMOTE CONTROL OF EXERCISE APPARATUS

[75] Inventors: George F. Henry, Woodinville; James S. Birrell, Seattle, both of Wash.

[73] Assignee: Precor Incorporated, Bothell, Wash.

[21] Appl. No.: 08/946,899

[22] Filed: Oct. 8, 1997

Related U.S. Application Data

[63] Continuation of application No. 08/635,456, Apr. 19, 1996, abandoned, which is a continuation of application No. 08/377,910, Jan. 25, 1995, abandoned.

[51] Int. Cl.[6] ..... A63B 21/075; A63B 22/00

[52] U.S. Cl. ..... 482/4; 482/5; 482/6; 482/93; 482/108; 482/51; 482/54

[58] Field of Search ..... 482/1, 4–7, 51, 482/54, 53, 105, 106, 108, 109, 901, 902; D14/218

[56] References Cited

U.S. PATENT DOCUMENTS

| | | | |
|---|---|---|---|
| D. 266,758 | 11/1982 | Johannsen et al. | D14/218 |
| 2,344,454 | 3/1944 | Plotner | 434/55 |
| 3,703,284 | 11/1972 | Hesen | 482/54 |
| 4,566,690 | 1/1986 | Schook | 482/106 |
| 4,630,817 | 12/1986 | Buckley . | |
| 4,711,447 | 12/1987 | Mansfield . | |
| 4,842,266 | 6/1989 | Sweeney, Sr. et al. | 482/7 X |
| 4,925,189 | 5/1990 | Braeunig . | |
| 5,033,740 | 7/1991 | Schwartz et al. | 482/108 |
| 5,139,261 | 8/1992 | Openiano . | |

*Primary Examiner*—John Mulcahy
*Attorney, Agent, or Firm*—Christensen O'Connor, Johnson & Kindness PLLC

[57] ABSTRACT

A hand-held transceiver (48) remotely controls a device (24) that is electrically coupled to a receiver (44) capable of receiving an electromagnetic transmission (46) and generating a first electrical signal (52) in response thereto. The device is controlled by the first electrical signal received from the receiver. The transceiver includes a body (56) configured to be hand-held by the person and a housing (43) to house a switch (50) that generates a second electrical signal in response to actuation of the switch. A transmitter (49) is also contained in the housing and is electrically connected to the switch for receiving the second electrical signal. In response thereto, the transmitter generates an electromagnetic transmission for receipt by the receiver (44) to in turn control the device. A weight (62) is couplable to the body for weighting the transceiver. Upper body exercise can be achieved by swinging or otherwise moving the transceiver in one hand, while at the same time remotely controlling the operation of the device.

7 Claims, 8 Drawing Sheets

WEIGHTED HAND-CONTROLLER FOR REMOTE CONTROL OF EXERCISE APPARATUS

This application is a continuation application of application Ser. No. 08/635,456, filed on Apr. 19, 1996, now abandoned, which is a continuation of application Ser. No. 08/377,910, filed on Jan. 25, 1995 now abandoned.

FIELD OF THE INVENTION

The present invention relates generally to exercise apparatus, and more particularly to control devices that may be used while exercising, for providing remote control of exercise apparatus.

BACKGROUND OF THE INVENTION

Numerous types of exercise devices are now available. Often the exercise apparatus is of a stationary type, such as a treadmill, rowing machine, stair-climbing machine, stationary bicycle, and etc. The advantage to these types of exercise apparatuses is that they do not require a substantial amount of space when in use, and thus, can be used indoors. A person can use these devices indoors without regard to inclement weather, or whether it is night or day.

Typically, these apparatuses focus on exercising the lower-body of a person, i.e., the person's legs. The legs include the larger muscles, which when exercised, require the greatest amount of oxygen, and consume the greatest amount of energy. Hence, by focusing on exercise of the lower-body of the person, a greater level of exercise can be achieved in a shorter period of time, relative to focusing on exercise of the upper-body of the person.

However, most people desire that their upper-body be exercised and toned, as well as their lower-body. Consequently, some types of exercise apparatus include provisions for simultaneously providing upper-body, and lower-body exercise. For example, one type of exercise apparatus provides for the gliding, reciprocating motion of a user's legs, similar to the motion used by cross-country skiers, while providing levers, or cables to simultaneously resist reciprocating motion of the user's arms. Another type of exercise apparatus requires the user to perform a climbing motion, similar to the motion a person engages in when climbing stairs. Reciprocating levers are provided to receive the user's feet, while reciprocating handles receive the user's hands.

Nevertheless, many people prefer to use hand-weights to exercise their upper body, rather than being restricted to reciprocating levers, cables, handles, or other devices. Consequently, many people will use a treadmill or stair-climbing type of device, while holding weights in their hand, such that they can swing their arms to obtain upper-body exercise.

Unfortunately, operation of these exercise apparatuses is difficult for most people when they are holding weights in their hands. In particular, it is often difficult to depress buttons to increase or decrease the level of exercise provided by the device, or to start or stop the device, while holding a weight in each hand. Accordingly, the present invention provides an improved solution to the problem of an controlling an exercise apparatus, while permitting a person to simultaneously obtain upper-body exercise through the use of hand-held weights.

SUMMARY OF THE INVENTION

The present invention is directed to a hand-held transceiver for use by a person to remotely control a device electrically coupled to a receiver that is capable of receiving an electromagnetic transmission and responsively generating a first electrical signal. The device is controlled by receipt of the first electrical signal from the receiver.

The transceiver includes a body configured to be hand-held by the person, and a switch for providing a second electrical signal in response to actuation of the switch. A transmitter is electrically connected to the switch for receiving the second electrical signal and for generating an electromagnetic transmission corresponding to the second electrical signal received from the switch.

A weight is connectable to the transceiver for selectively adjusting the total weight of the transceiver. Thus, the person can use the transceiver in upper body exercise regimes by swinging and otherwise moving the transceiver.

In a preferred embodiment, the transceiver further includes a plurality of individual weights for adjusting the total weight of the transceiver. By connecting different weights to the transceiver, the total weight of the transceiver can be adjusted, such that the person can obtain different levels of upper body exercise. Preferably, the weights are in the form of segments that are interconnectable with one another to form the body of the transceiver.

The present invention also provides a controller system for wireless remote control of an apparatus having several different exercise levels. Each exercise level requires a person using the exercise apparatus to exert a different amount of physical effort. The exercise apparatus includes a central processing unit electrically connected to the exercise apparatus for controlling the exercise level of the exercise apparatus in response to a first electrical signal.

The controller system includes a transceiver, which is configured to be hand-held. A transmitter and a switch are mounted to the transceiver, and are electrically connected to one another. Actuation of the switch produces a second electrical signal that is received by the transmitter. In response to receiving the second electrical signal from the switch, the transmitter generates an electromagnetic transmission corresponding to the second electrical signal received from the switch.

The controller system includes a receiver, which is electrically connectable to the central processing unit of the exercise apparatus. The receiver receives the electromagnetic transmission from the transmitter, and responsively provides the first electrical signal for receipt by the central processing unit. The central processing unit sets the exercise level of the apparatus based upon the first electrical signal received from the receiver.

Manual control of the exercise apparatus is also provided in accordance with the invention by a switch that is electrically coupled to the central processing unit. Pressing this switch causes an electrical signal to be received by the central processing unit, which controls the exercise level of the apparatus based upon this signal, and/or based upon the electrical signal received from the receiver.

The transceiver may be weighted to provide upper-body exercise to the person while using the exercise apparatus. In the preferred embodiment, the transceiver is weighted by removably attaching weights to the transceiver such that the weight of the transceiver is adjustable to vary the level of exercise provided to the upper-body of the person while using the exercise apparatus. Additionally, the invention includes providing a weight to be held in the other hand of the person, so that both sides of the person receive upper-body exercise. Preferably, the weight is adjustable to match the mass of the transceiver so both sides of the person receive generally equal levels of upper-body exercise.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
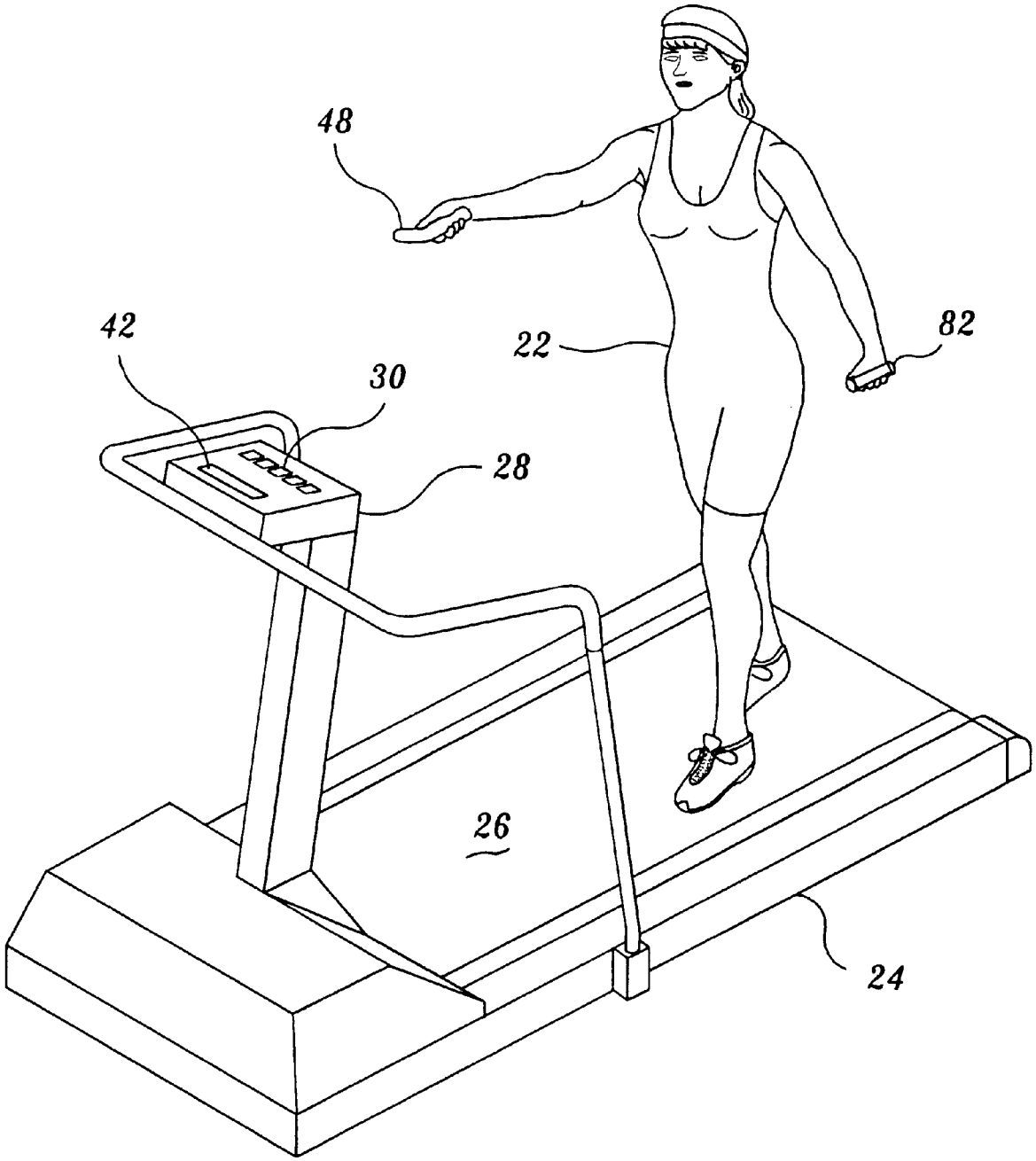
FIG. 1 shows a perspective view of a person exercising upon an exercise apparatus using a weight assembly, and a hand-held transceiver in accordance with the present invention to control the exercise apparatus, and to obtain upper body exercise.

FIG. 1 illustrates a person 22 exercising upon a treadmill 24 of conventional design. The treadmill 24 includes an endless belt 26, which is driven by one or more electric motors (not shown). The person 22 walks or jogs upon the endless belt 26 as it is driven by the motor or motors, for exercise.

A plurality of exercise levels is provided by the treadmill 24. Each exercise level requires the person 22 to exert a different amount of physical effort. The person 22 can select different exercise levels by pressing buttons 30 on a control panel 28 mounted to the forward portion of the treadmill 24 to adjust the speed and/or inclination of the endless belt 26.

Figure 10:
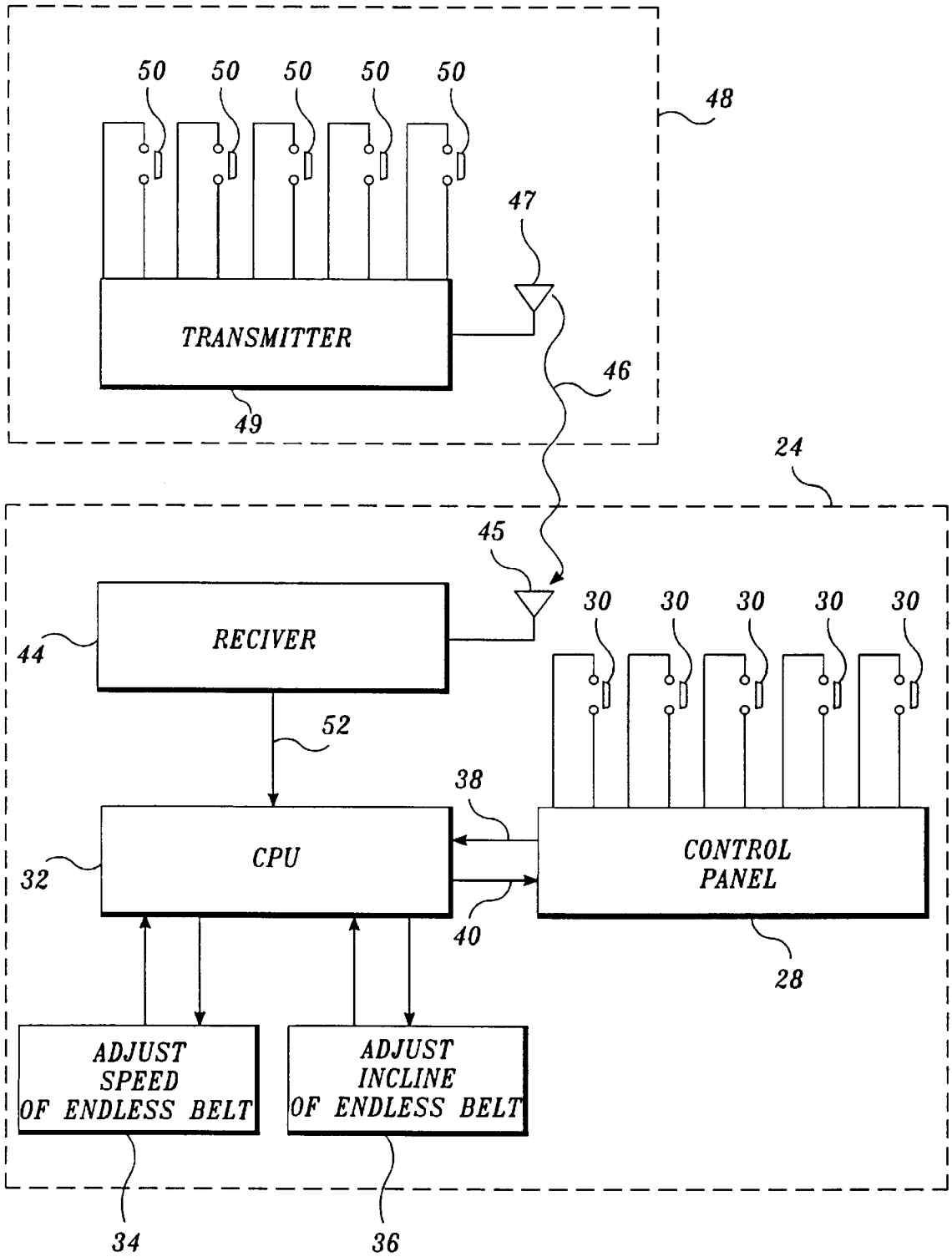
FIG. 10 is a schematic, electrical block diagram for controlling the exercise apparatus of FIG. 1, with the transceiver of FIG. 1.

As shown in FIG. 10, a central processing unit (CPU) 32 electrically connects to the control panel 28, and to solenoid units 34 and 36 that respectively adjust the speed and inclination of the endless belt 26. When a button 30 is depressed, the CPU 32 receives an electrical signal 38 commanding the CPU to either adjust the speed or inclination of the endless belt 24.

Electrical signals 40 are also received by the control panel 28 from the CPU 32 for presenting data to the person 22 on a display panel 42 (see FIG. 1) on the control panel 28. The data displayed is information such as the speed or inclination of the endless belt 26, the amount of time the person 22 has spent exercising from a start time, the amount of calories burned by the person, etc.

However, treadmill 24 is different from a conventional treadmill in one primary respect. In accordance with the present invention, the treadmill 24 includes a receiver 44 that is electrically connectable to the CPU 32. Receiver 44 may be of standard design, having an antenna 45 for receiving electromagnetic transmissions 46 from a transceiver 48. When the receiver 44 is electrically connected to the CPU 32, the receiver provides an electrical signal 52 to the CPU 32 in response to receiving electromagnetic transmissions 46 from the transceiver 48. The electrical signal 52 from the receiver 44 corresponds to the electrical signal 38 provided by the buttons 30 of the control panel 28.

The transceiver 48 includes a transmitter 49 of conventional design having an antenna 47, and preferably includes a number of buttons 50 corresponding to the number of buttons 30 on the control panel 28 of the treadmill 24. The transmitter 49 includes an electronic circuit (not shown) of a type well known in the art for generating an electromagnetic transmission 46. When a button 50 is pressed by the thumb, the transceiver 48 generates the electromagnetic transmission 46, which emanates from an antenna 47 and is received by the antenna 45 of the receiver 44. Thus, the CPU 32 can be commanded to adjust the speed or inclination of the treadmill by either pressing buttons 30 on the control panel 28, or buttons 50 on the transceiver 48. (The buttons 30 and 50 are conventional switches configured to remain in the open position until depressed and whereupon the switches revert back to the open condition when the depressing force is removed).

Preferably, the electromagnetic transmission 46 generated by the transceiver is in the radio frequency range, and has a frequency of around 900 MHz. Radio frequency electromagnetic transmissions spread rapidly so that the receiver 44 is able to receive transmissions 46 without requiring the person 22 to direct the antenna 47 of the transceiver 48 towards the antenna 45 of the receiver 44.

Alternately, the electromagnetic transmission 46 may be in the infrared frequency range. Preferably, the receiver 44 is located behind the control panel 28, along with the CPU 32. Thus, if the transmission 46 is of a type that does not spread rapidly, or has a weak signal strength, the person 22 can easily direct the antenna 47 of the transceiver towards the receiver 44 to improve reception by the receiver.

Figure 2:
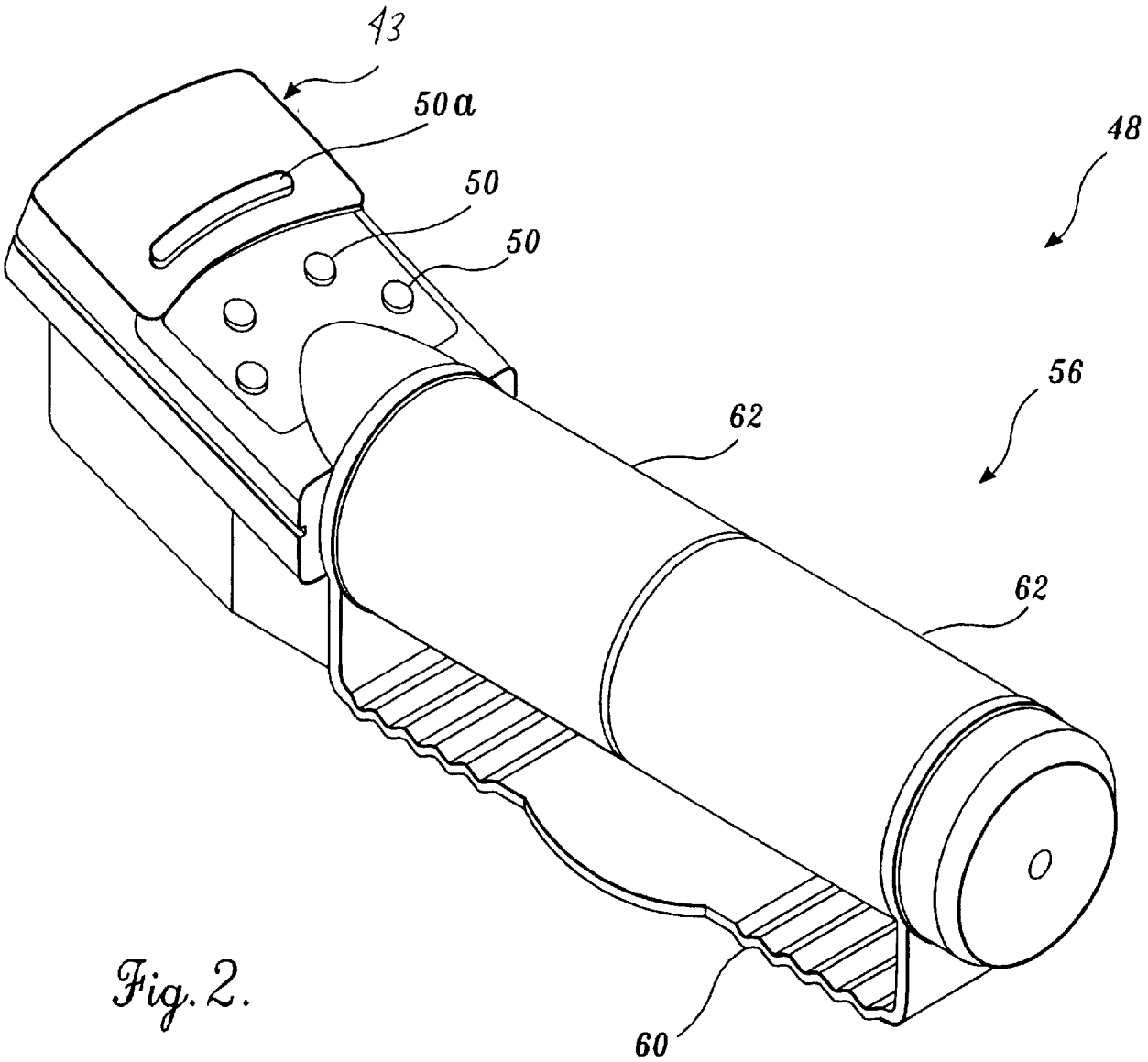
FIG. 2 is an enlarged perspective view of the hand-held transceiver of FIG. 1.

Referring to FIG. 2, the transmitter 49 is preferably mounted in a sealed housing 43. The sealed housing 43 prevents moisture, such as sweat, from coming into contact with the transmitter 49 mounted therein, and damaging the transmitter. In a preferred embodiment, the housing 43 is made of plastic or other appropriate material, which has good moisture resistant properties.

The housing 43 is configured to be held in one hand of the person 22. For this purpose, the housing 43 includes a handle assembly 56 extending from one end of the housing 43 for grasping by a hand of the person 22. Thus, the person 22 can hold the transceiver 48 with one hand by the handle assembly 56 when using the treadmill 24 for wireless remote control of the speed and inclination of the endless belt 26.

The buttons 50 project through the upper surface of the housing 43, and connect to the transmitter 49 mounted in the housing. As illustrated in FIG. 2, the housing 43 is ergonometrically angled upward relative to the central axis of the handle assembly 56. In operation, the person 22 uses the fingers of one hand to grasp the handle assembly 56, while the thumb of the grasping hand is positioned over the buttons 50 projecting through the upper surface of the housing 43.

A strap 60 connects to opposite ends of the handle assembly 56. The strap 60 is disposed along the back of the grasping hand. This arrangement provides a secure, comfortable grip for either the left or right hand of the person 22, and enables the person 22 to use his or her thumb of the grasping hand to readily press the buttons 50 projecting through the housing 43.

In a preferred embodiment, the arrangement of the buttons 50 upon the transmitter unit 58 generally corresponds to the arrangement of the buttons 30 upon the control panel 28. For example, if the leftmost button 30 of the control panel 28 is for increasing the inclination of the treadmill 24, then preferably, the leftmost button of the transmitter unit 58 is also for increasing the inclination of the treadmill. Thus, the person 22 only has to learn one arrangement of buttons 30 or 50 for controlling the treadmill 24.

The control panel 28 of the treadmill 24 is illustrated as having five buttons 30, which is typical of many tread mills. Usually, treadmills having five such buttons, include a control panel with the buttons arranged generally from left-to-right, relative to a person using the treadmill. Moving from left-to-right across the control panel, the buttons are typically for performing the following respective functions: (1) increasing the inclination of the treadmill; (2) decreasing the inclination of the treadmill; (3) stopping the endless belt; (4) decreasing the speed of the endless belt; and (5) increasing the speed of the endless belt.

Consequently, if the transceiver 48 is used with one of these types of treadmills, preferably the transceiver would include five buttons corresponding to the five buttons of the treadmill. The buttons of the transceiver 48 would also have a generally left-to-right arrangement relative to the person 22 holding the transceiver, wherein each button of the transceiver performs the same function that the corresponding button of the treadmill performs.

Button 50*a* is indicated as being significantly elongated relative to the other buttons 50. Preferably button 50*a* is a stop button that the person 22 can press to rapidly stop the endless belt 26. This enables the stop button 50*a* to be easily distinguished from the other buttons 50 of the transceiver 48. Usually, the stop button on a treadmill is the central button.

Figure 4:
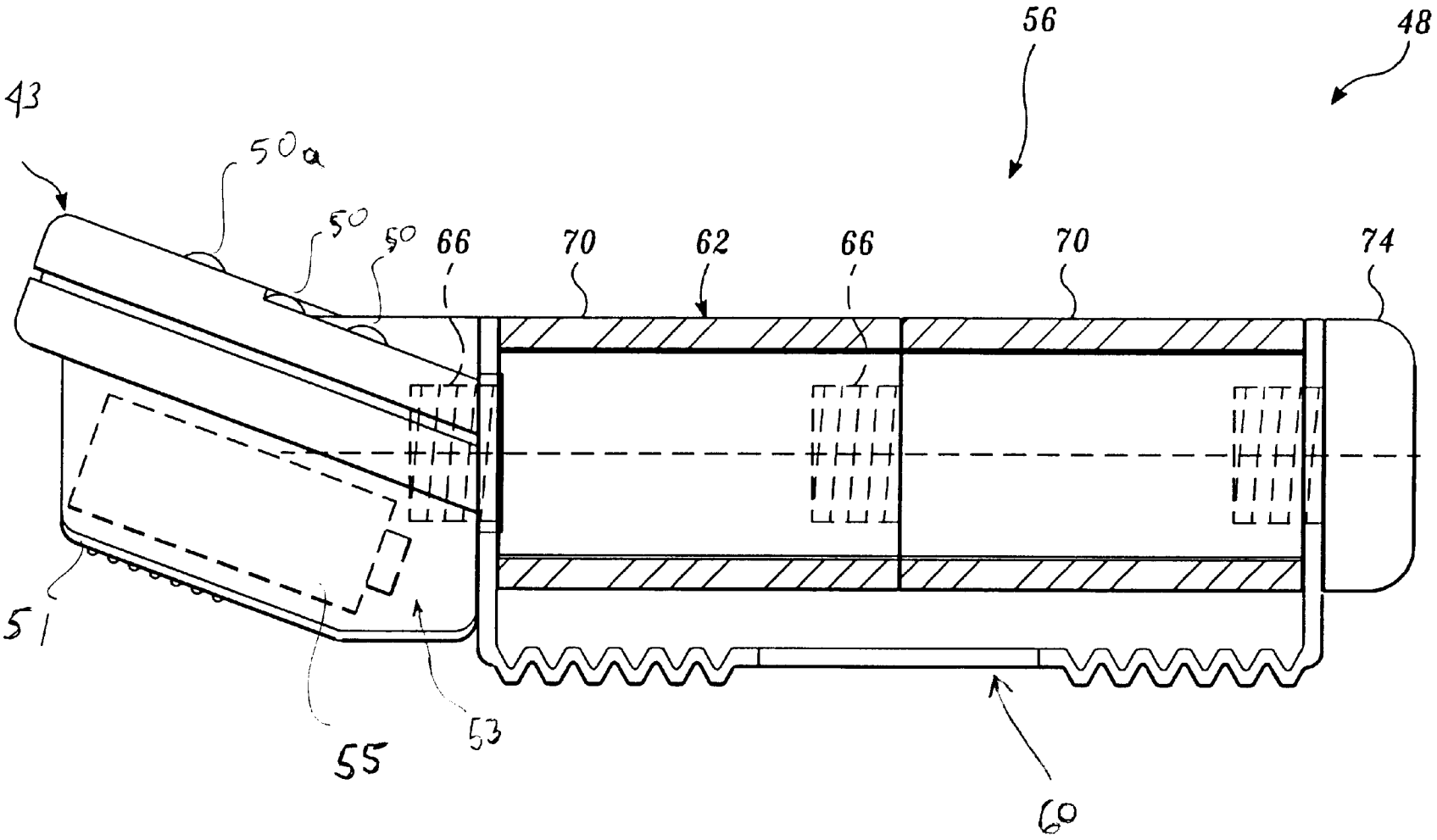
FIG. 4 is a cross-sectional view of the hand-held transceiver of FIGS. 1 and 2.

Referring to FIG. 4, the side of the housing 43 opposite the buttons 50, includes a removable door 51 that leads to a battery compartment 53. The battery compartment 53 is for containing a battery 55 for supplying electrical power to the transmitter 49. In a preferred embodiment, the transmitter 49 is powered by a standard 9 volt battery. However, it will be readily appreciated by those skilled in the art, that the transmitter can be powered by many other types of batteries, or plurality of batteries, such as AA, AAA, C, or D size standard batteries. Additionally, the transmitter could be powered by rechargeable types of batteries, such as lithium, nickel-cadmium, or lead-acid batteries. However, if rechargeable batteries are used, preferably lithium or nickel-cadmium types are used because of their lighter weight and ruggedness relative to lead-acid types. The transmitter 49 for generating the electromagnetic transmission 46 is preferably located above the battery 53, and connects to the buttons 50.

Figure 5:
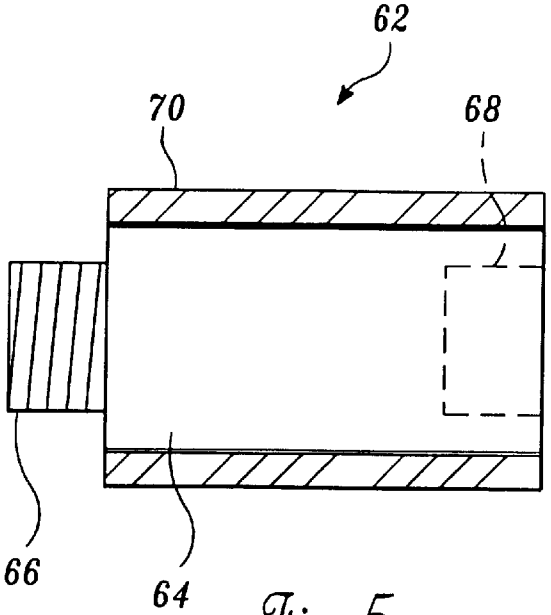
FIG. 5 is a side view of a part of the weight assembly of FIGS. 1 and 3.

The handle assembly 56 includes two weight segments 62 that are connected at one end to one another. The opposite end of each weight segment 62 connects to opposite ends of the strap 60. Referring to FIG. 5, which is a side view of a weight segment 62, each weight segment includes a generally cylindrically shaped main body portion 64. A generally cylindrically shaped nose portion 66 having external threads, coaxially extends from one end of the main body portion 64. The other end of the main body portion 64 includes a generally cylindrically shaped recess 68, indicated in phantom, of a diameter corresponding to the diameter of the nose portion 66. The recess 68 includes internal threads corresponding to the external threads formed on the nose portion 66. The weight segments 62 connect to one another by the nose portion 66 of one weight segment being threaded into the recess 68 of another weight segment.

Preferably, the main body portion 64 of each weight segment 62 includes an outer sheath 70 formed of a conventional resilient or spongy material that is resistant to moisture, such as polyurethane foam. The outer layer 70 provides for a secure comfortable grip for the person 22 grasping the handle assembly 56 in his or her hand.

The housing 43 includes a cylindrical recess substantially identical to cylindrical recess 68 in the weight segments 62. The handle assembly 56 is secured to the housing 43 by threading the nose portion 66 of a weight segment 62 into the cylindrical recess formed in the housing.

Figure 8:
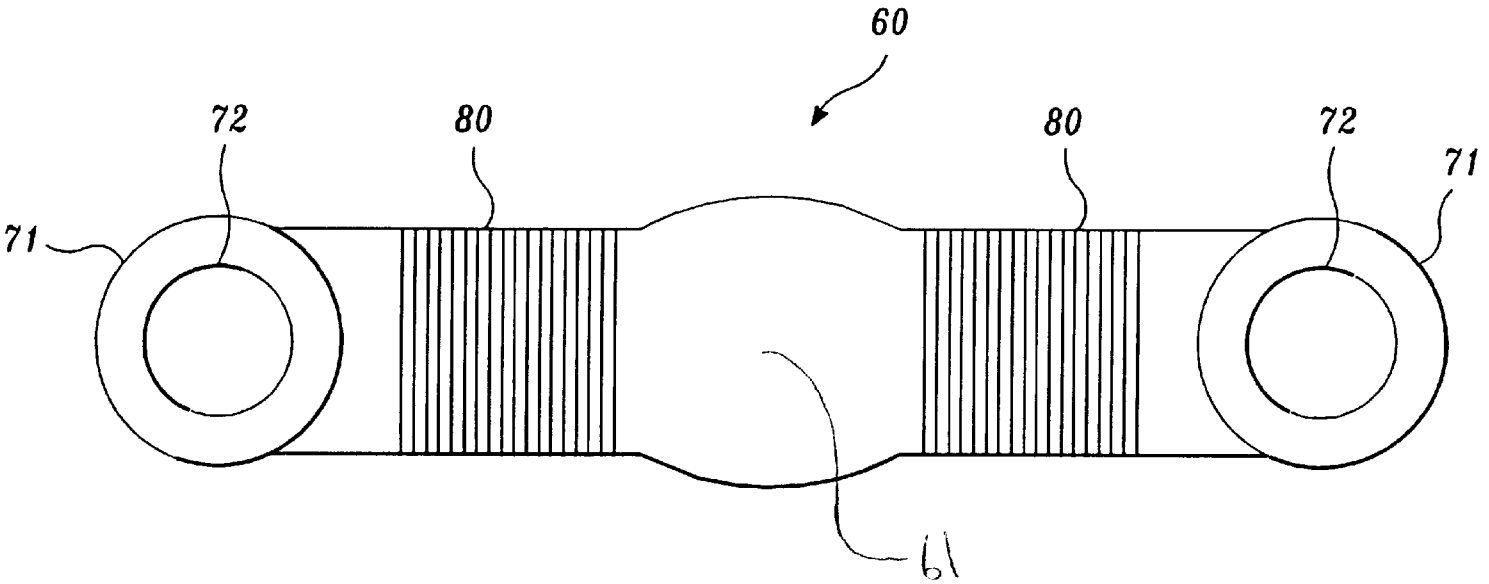
FIGS. 8 and 9 are top and side views, respectively, of a part that is included with the weight assembly of FIGS. 1 and 3, and that is also included with the transceiver of FIGS. 1 and 2.
Figure 9:
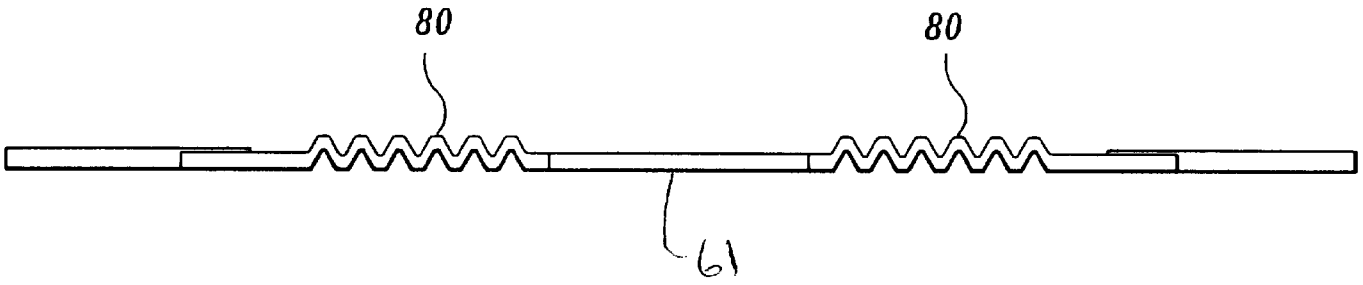

Strap 60 includes washer-shaped portions 71 at each end of the strap, as shown in FIGS. 8 and 9. A hole 72 is formed centrally through each washer-shaped portion 71 to slidably receive the nose portion 66 of a weight segment 62. As indicated in FIG. 4, one end of the strap 60 is secured between the housing 43 and the handle assembly 56 by the nose portion 66 of a weight segment 62 extending through the hole 72 of the strap. Thus, when the nose portion 66 is threaded into the cylindrical recess of the housing 43, this end of the strap is held between the housing and the handle assembly 56.

Figure 6:
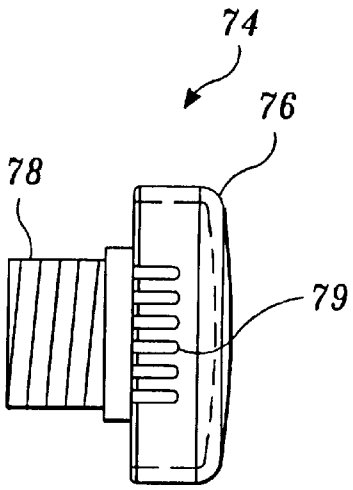
FIG. 6 is a side view of a part that is included with the weight assembly of FIGS. 1 and 3, and that is also included with the transceiver of FIGS. 1 and 2.

The opposite end of the strap 60 is secured in the handle assembly 56 by a plug 74. As shown in FIG. 6, plug 74 includes a generally cylindrically shaped cap portion 76 having one edge that is rounded and a projecting stem portion 78. Stem portion 78 coaxially extends from cap portion 76, and is of a diameter substantially equal to nose portion 66 of the weight segments 62. Further, stem portion 78 includes external threads substantially identical to nose portion 66 of the weight segments 62. Thus, stem portion 78 is threadable into the cylindrical recess 68 of a weight segment 62.

Plug 74 secures the other end of strap 60 to the handle assembly 56 by the stem portion 78 of the plug extending through the hole 72 in the strap. The part of the stem portion 78 that extends through the strap 60 is threaded into the cylindrical recess 68 of the weight segment 62, and tightened down. Thus, the end of the strap 60 is held between the plug 74, and a weight segment 62 of the handle assembly 56. Axial grooves 79 are formed in the outer surface of the cap portion 76 to facilitate hand tightening of the plug 74 to a weight segment 62.

When the strap 60 is held between the housing 43 and the handle assembly 56, the washer-shaped portion 71 of the strap acts as a washer, permitting the strap 60 to rotate relative to the housing and the handle assembly. The same is also true for the other end of the strap 60. That is, when the other end of the strap 60 is held between the plug 74 and the handle assembly 56, the washer shaped portion 71 allows the strap to rotate. Rotation of the strap 60 relative to the housing 43 and the handle assembly 56 permits the strap to be adjusted to accommodate various grips and thumb angles in accordance with individual user preferences.

Referring to FIGS. 8 and 9, the strap 60 includes an accordion portion 80 disposed between each washer portion 71, and the central body portion 61 of the strap. The accordion portions 80 permit the strap to expand and tighten to accommodate various hand sizes of different users.

Figure 3:
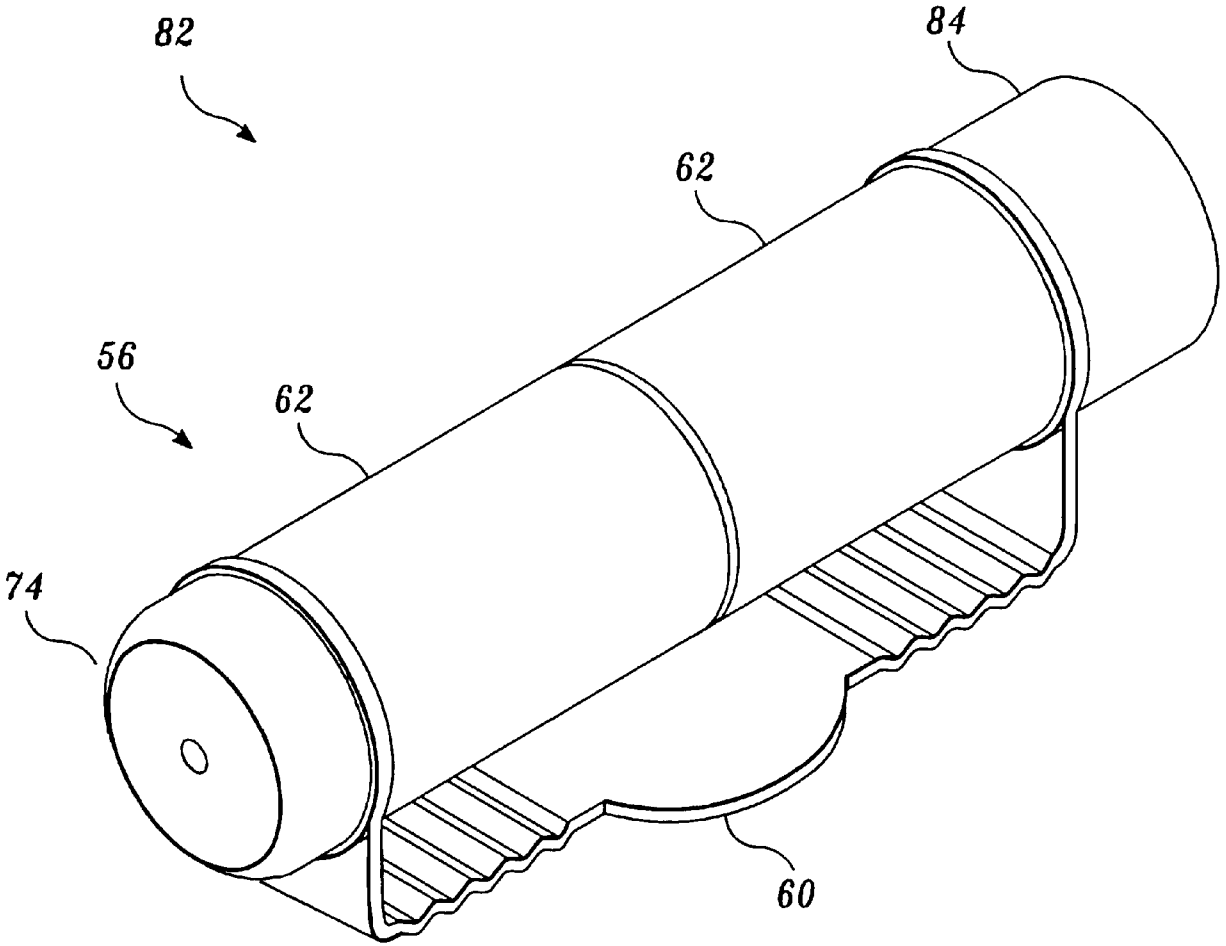
FIG. 3 is an enlarged perspective view of the weight assembly of FIG. 1.

A weight assembly 82 is also provided in a preferred embodiment in accordance with the present invention. The weight assembly 82 is to be held in the other hand of the person 22 from the hand holding the transceiver 48, as illustrated in FIGS. 1 and 3. Referring to FIG. 3, the weight assembly 82 includes the handle assembly 56 as described previously in connection with the transceiver 48. In particular, the handle assembly 56 of the weight assembly 82 includes two weight segments 62 that are threadably connected to one another at one end. A strap 60 connects to one end of the handle assembly 56 by a plug 74, previously described in connection with FIG. 6, which threads into one end of a weight segment 62.

Figure 7:
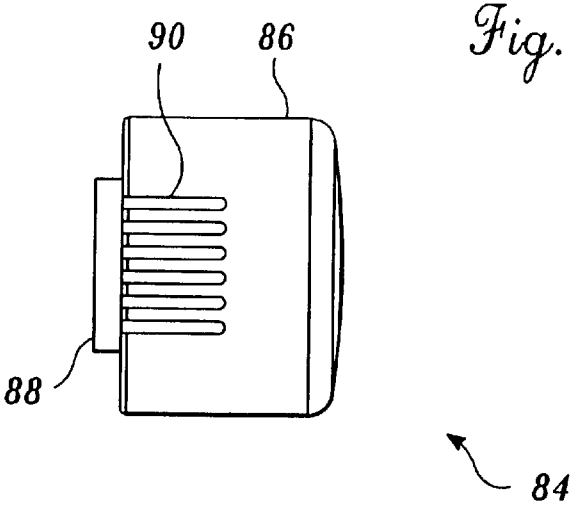
FIG. 7 is a side view of a part of the weight assembly of FIGS. 1 and 3.

The other end of the strap 60 is connected to the handle of handle assembly 56 by a cap 84. Cap 84 includes a generally cylindrically shaped main body portion 86 having one end that is rounded as illustrated in FIG. 7. A reduced diameter boss 88 coaxially extends from the end of the main body portion of the cap 86, opposite from the rounded end. Boss 88 includes internal threads substantially identical to the internal threads formed in the cylindrical recess 68 of the weight segment 62. Thus, cap 84 is threadable onto the nose portion 66 of a weight segment 62.

Cap 84 is used to secure an end of strap 60 to a handle assembly 56, by extending nose portion 66 by weight segment 62 through a hole 72 in one end of the strap. Cap 84 is threaded onto the part of the nose portion 66 that extends through the strap 60, and tightened down. Thus, the end of the strap is rotatably held between cap 84 and a weight segment 62. Cap 84 includes axial grooves 90 formed in the main body portion of the cap 86 to facilitate hand tightening of the cap to a weight segment 62.

In a preferred embodiment, the weight segments 62 are made of different weights so that the person 22 can form a handle assembly 66 of a selected weight. Preferably, some of the weight segments 62 comprise steel and have a weight of approximately one pound. Other weight segments 62 primarily comprise a less dense material, such as plastic. Thus, if two weight segments 62 comprising primarily plastic, were combined together to form a handle assembly 56, the weight of such a handle assembly 56 when connected to the transmitter 49 would approximate the weight of a conventional remote control for a television. Conversely, if a weight assembly 62 comprising steel was combined with a weight segment 62 comprising mainly plastic, the weight of a handle assembly 56 would have a weight of around one pound. If two weight segments 62, comprising steel, were combined together to form a handle assembly 56, the transceiver 48 would have a weight of approximately two pounds, when used with such a handle assembly 56. The weight of the weight assembly 82 can also be varied in the same fashion. In alternate embodiments, weight segments 62 can be provided having different weights.

Figure 11:
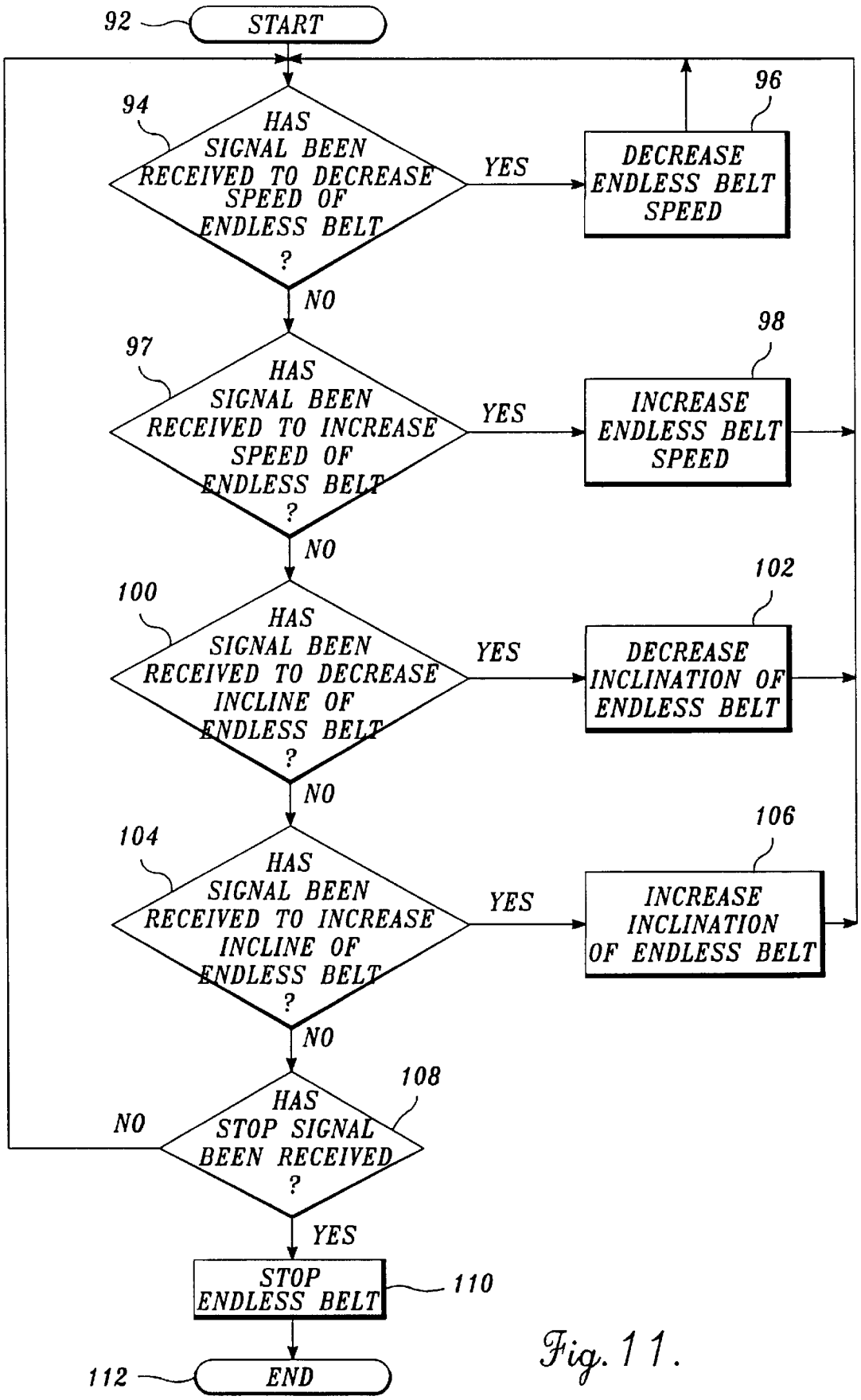
FIG. 11 is a flow chart illustrating logic used with the exercise apparatus of FIG. 1 to permit the exercise apparatus to be controlled by the transceiver of FIG. 1.

FIG. 11 is a flow chart showing overall logic suitable for use in the CPU 32 of a treadmill 24 that is remotely controlled by a transceiver 48 in accordance with the present invention. After a start block 92 in FIG. 11, a decision block 94 determines if a signal has been received to decrease the speed of the endless belt 26. If so, a block 96 decreases the speed of the endless belt 26, and the logic repeats.

Otherwise, the logic proceeds to a decision block 97, which determines whether a signal has been received to increase the speed of the endless belt 26. If so, block 98 increases the speed of the endless belt 26, and the logic repeats.

If a signal has not been received to increase the speed of the endless belt 26, decision block 100 determines whether or not a signal has been received to decrease the inclination of the endless belt 26. If so, block 102 decreases the inclination of the endless belt 26, and the logic repeats.

Otherwise, decision block 104 determines whether or not a signal has been received to increase the inclination of the endless belt 26. If so, block 106 increases the inclination of the endless belt 26, and the logic repeats.

If not, decision block 108 determines whether or not a stop signal has been received. If a stop signal has not been received, the logic repeats. Otherwise, block 110 stops the endless belt 26, and the logic terminates in an end block 112.

In other embodiments of the invention, the treadmill 24 can be replaced with other types of exercise apparatuses having a plurality of exercise levels. For example, the transceiver 48 could be used to remotely control a stair climbing or skiing type of exercise apparatus, rather than a treadmill. Stationary bicycles or rowing-type exercise devices could also be remotely controlled with the transceiver 48.

Additionally, the transceiver 48 could be used to remotely control a video cassette recorder (VCR), television, sound systems, or other devices while a user is exercising. More particularly, the user could use the transceiver 48 while performing step exercises, or aerobic exercises, and simultaneously control other devices, such as audio-visual equipment. The weight assembly 82 could be used in conjunction with the transceiver 48, such that the user obtains balanced upper-body exercise by holding the transceiver 48 in one hand, and the weight assembly 82 in the other hand, while performing step, aerobic, or other type of exercises.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A handheld controller for controlling an exercise apparatus having a plurality of exercise levels, one of the plurality of exercise levels being selectable based on a control signal received by a receiver in the exercise apparatus, the handheld controller comprising:

(a) a plurality of weights couplable to form a handle for manually grasping the handheld controller;

(b) a strap coupled to the plurality of weights, to prevent unintentional dropping of the handheld controller;

(c) a transmitter coupled to the plurality of weights for generating and transmitting a control signal corresponding to a desired exercise level; and (d) manually operable control means connected to the transmitter, the control means causing the transmitter to selectively transmit a control signal corresponding to a desired exercise level.

2. The handheld controller of claim 1, wherein the strap is removable.

3. The handheld controller of claim 1, wherein each of the plurality of weights has substantially the same mass.

4. The handheld controller of claim 1, wherein the plurality of weights are generally cylindrical in shape and couple together along a longitudinal axis.

5. The handheld controller of claim 1, wherein each of the plurality of weights is constructed with a threaded bore and a threaded member, the threaded member of one of the plurality of weights being screwed into the threaded bore of an adjacent one of the plurality of weights in order to couple the weights together.

6. The handheld controller of claim 1, wherein the control means includes a plurality of pushbuttons.

7. The handheld controller of claim 6, wherein the plurality of pushbuttons are operable by the thumb of the user.

* * * * *

UNITED STATES PATENT AND TRADEMARK OFFICE

CERTIFICATE OF CORRECTION

PATENT NO. : 5,910,070

DATED : June 8, 1999

INVENTOR(S) : G.F. Henry et al.

It is certified that error appears in the above-identified patent and that said Letters Patent is hereby corrected as shown below:

| COLUMN | LINE | ERROR |
|---|---|---|
| 8 (Claim 5, | 48 line 1) | "of claim 1," should read --of claim 4,-- |
| Title page, Col. 2 | Attorney, Agent, or Firm | After "O'Connor" delete "," |

Signed and Sealed this

Second Day of November, 1999

*Attest:*

*Attesting Officer*

Q. TODD DICKINSON

*Acting Commissioner of Patents and Trademarks*